US006416042B1

(12) United States Patent
Popov

(10) Patent No.: US 6,416,042 B1
(45) Date of Patent: Jul. 9, 2002

(54) GAS-LIQUID EJECTOR

(75) Inventor: Serguei A. Popov, 4615 Post Oak Pl. Suite 140, Houston, TX (US) 77027

(73) Assignees: Evgueni D. Petroukhine, Limossol (CR); Serguei A. Popov, Budapest (HU)

( * ) Notice: Subject to any disclaimer, the term of this patent is extended or adjusted under 35 U.S.C. 154(b) by 0 days.

(21) Appl. No.: 09/445,537

(22) PCT Filed: Mar. 15, 1999

(86) PCT No.: PCT/IB99/00416

§ 371 (c)(1),
(2), (4) Date: Dec. 8, 1999

(87) PCT Pub. No.: WO99/47818

PCT Pub. Date: Sep. 23, 1999

(30) Foreign Application Priority Data

Mar. 16, 1998 (RU) ..... 98105007

(51) Int. Cl.[7] ..... B01F 3/04
(52) U.S. Cl. ..... 261/76
(58) Field of Search ..... 261/76, DIG. 75; 239/338, 428.5; 417/158, 151

(56) References Cited

U.S. PATENT DOCUMENTS

| | | | | |
|---|---|---|---|---|
| 2,382,391 A | | 8/1945 | Berman | |
| 2,582,069 A | | 1/1952 | Rose | |
| 5,628,623 A | * | 5/1997 | Skaggs | 417/151 |
| 6,199,834 B1 | * | 3/2001 | Popov et al. | 261/76 |
| 6,224,042 B1 | * | 5/2001 | Popov et al. | 261/76 |

FOREIGN PATENT DOCUMENTS

| | | | |
|---|---|---|---|
| SU | 393478 | | 12/1973 |
| SU | 985462 | | 12/1982 |
| SU | 1483106 | | 5/1989 |
| WO | WO 99/31392 | * | 6/1999 |

OTHER PUBLICATIONS

Sokolov E.Y. and Zinger N.M., "Jet apparatuses" book, 1989 USSR, Moscow, "Energoatomizdat" Publishing house, pp. 94, 95, 213, 214.

* cited by examiner

*Primary Examiner*—C. Scott Bushey
(74) *Attorney, Agent, or Firm*—Mark A. Oathout

(57) ABSTRACT

A liquid-gas ejector comprising a nozzle and a mixing chamber is disclosed, wherein the distance between the outlet section of the nozzle and the inlet section of the mixing chamber of a liquid-gas ejector is determined from the following formula:

$$L = k \cdot \sqrt{\frac{G\alpha}{\mu}}$$

where

L—distance between the outlet section of the nozzle and the inlet section of the mixing chamber (mm);

k—design factor, ranging from 0.001 to 0.3;

α—ratio of the surface area of the minimal cross-section of the active nozzle to the surface area of the minimal cross-section of the mixing chamber;

G—liquid flow rate through the nozzle (g/sec);

μ—coefficient of resistance of the nozzle (g/sec*mm$^2$), amounting from 0.5 to 1.1. A liquid-gas ejector realized according to the above-mentioned formula exhibits a higher efficiency factor.

1 Claim, 1 Drawing Sheet

GAS-LIQUID EJECTOR

DESCRIPTION

1. Technical Field

The present invention pertains to the field of jet technology, primarily to liquid-gas ejectors for producing a vacuum during evacuation of various gaseous and gas-vapor mediums.

2. Background Art

An ejector is known, which comprises a steam nozzle, a mixing chamber, converging in the flow direction, with a throttle and a diffuser (see, Sokolov E. Y. & Zinger N. M., "Jet Apparatuses", Moscow, "Energoatomizdat" Publishing house, 1989, pages 94–95).

Ejectors of this type are widely adopted for evacuation of gas-vapor mediums in the condenser units of steam turbines and in steam-ejector refrigeration units.

However efficiency of these ejectors is relatively low in cases when the evacuated gaseous mediums contain a lot of condensable components.

The closest analogue of the ejector introduced in the present invention is a liquid-gas ejector comprising a liquid nozzle and a mixing chamber (see, Sokolov E. Y. & Zinger N. M., "Jet Apparatuses", Moscow, "Energoatomizdat" Publishing house, 1989, pages 213–214).

Such ejectors are used in power engineering as air-ejector devices of condenser units, in water deaeration vacuum systems, for vacuumization of various reservoirs. Character of the given ejectors is the fact that while evacuating a steam-air mixture the steam contained in the mixture is condensed and therefore a water-air mixture is compressed in the mixing chamber (if water is used as the liquid medium fed into the nozzle).

But the operational effectiveness of these ejectors is not high enough because performance of the ejector significantly depends on the distance between the outflow face of the nozzle and the inflow face of the mixing chamber.

DISCLOSURE OF INVENTION

The problem to be solved by the present invention is an increase in efficiency of a liquid-gas ejector comprising a nozzle and a mixing chamber by optimization of the distance between the outflow face of the nozzle and the inflow face of the mixing chamber.

The stated problem is settled as follows: in a liquid-gas ejector comprising a nozzle and a mixing chamber the distance between the outlet section of the nozzle and the inlet section of the mixing chamber is determined from the following formula:

$$L = k \cdot \sqrt{\frac{G\alpha}{\mu}}$$

where

L—distance between the outlet section of the nozzle and the inlet section of the mixing chamber (mm);

k—design factor, ranging from 0.001 to 0.3;

α—ratio of the surface area of the minimal cross-section of the active nozzle to the surface area of the minimal cross-section of the mixing chamber;

G—liquid flow rate through the nozzle (g/sec);

$\mu$—coefficient of resistance of the nozzle (g/sec*mm$^2$), amounting from 0.5 to 1.1.

Experimental research has shown, that the distance from the outlet cross-section of a nozzle of a liquid-gas ejector to the inlet cross-section of a mixing chamber of the ejector exerts significant influence on the effectiveness of evacuation of a gaseous medium by the liquid-gas ejector. It was determined that optimal value of this distance depends mainly on the liquid flow rate and coefficient of resistance of the nozzle.

The coefficient of resistance of a liquid-gas ejector nozzle is calculated by the following mathematical expression:

$$\mu = \frac{G}{\sqrt{\frac{2F_c gP}{\gamma}}}$$

where $\mu$—coefficient of resistance of the nozzle (g/sec*mm$^2$),

G—liquid flow rate through the nozzle (g/sec);

$F_c$—surface area of the minimal cross-section of the nozzle;

g—acceleration of gravity;

P—pressure of the liquid fed into the nozzle;

γ—density of the liquid fed into the nozzle.

It was discovered that it is advisable to implement the nozzles, whose coefficient of resistance ranges from 0.5 to 1.1 g/sec*mm$_2$.

In addition, it was determined that degree of dispersion of a liquid jet at the nozzle outlet significantly depends on the liquid pressure at the nozzle inlet, liquid flow rate through the nozzle and surface area of the minimal cross-section of the nozzle. In its turn it was determined that optimal distance between the outlet cross-section of the nozzle and the inlet cross-section of the mixing chamber depends both on the ratio between surface areas of the minimal cross-section of the nozzle and mixing chamber and shape of the dispersed liquid jet behind the nozzle outlet. The jet shape is understood first of all as a degree of atomization of the liquid stream behind the outlet of the nozzle. The most important result of the experiments is that interference of these parameters was uncovered and it became possible to determine more precisely the optimal distance between the outlet cross-section of the nozzle and inlet cross-section of the mixing chamber as well as other optimal dimensions of the liquid-gas ejectors subject to specified operational parameters.

Thus, using the above mentioned formula obtained on the basis of experimental data analysis, it is possible to develop liquid-gas ejectors which have an increased efficiency factor and require minimal energy input for the evacuation of gaseous mediums.

Figure 1:
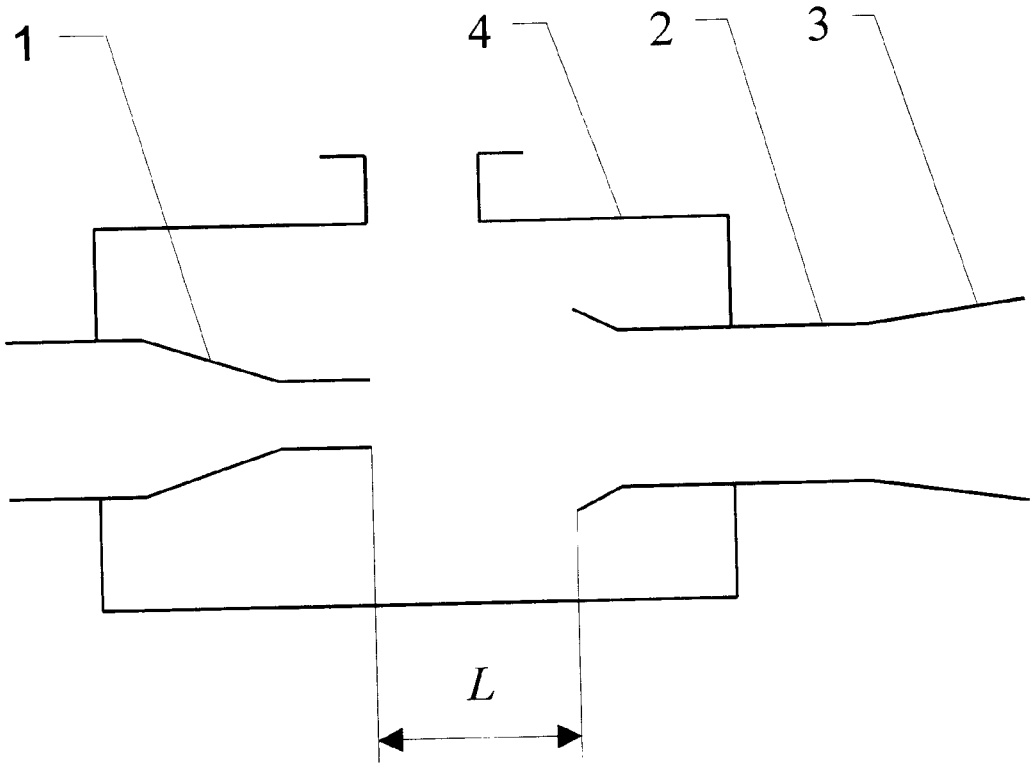
FIG. 1 represents a schematic diagram of the described liquid-gas ejector.

The liquid-gas ejector comprises an active nozzle 1, a mixing chamber 2 with a diffuser 3 (if the latter is installed) and a receiving chamber 4.

Distance (L) between the outlet section of the nozzle 1 and the inlet section of the mixing chamber 2 is determined from the following formula:

$$L = k \cdot \sqrt{\frac{G\alpha}{\mu}}$$

where

L—distance between the outlet section of the nozzle and the inlet section of the mixing chamber (mm);

k—design factor, ranging from 0.001 to 0.3;

α—ratio of the surface area of the minimal cross-section of the active nozzle to the surface area of the minimal cross-section of the mixing chamber;

G—liquid flow rate through the nozzle (g/sec);

$\mu$—coefficient of resistance of the nozzle (g/sec*mm$^2$), amounting from 0.5 to 1.1.

The liquid-gas ejector operates as follows.

A liquid medium under a specified pressure is fed into the nozzle 1. Flowing out from the nozzle 1, a dispersed liquid flow entrains an evacuated gaseous medium from the receiving chamber 4 into the mixing chamber 2, where the liquid mixes with the gaseous medium and compresses it at the same time. A gas-liquid mixture from the mixing chamber 2 gets into the diffuser 3 (if it is installed behind the mixing chamber) and then passes to destination.

INDUSTRIAL APPLICABILITY

The described liquid-gas ejector can be applied in the chemical, petrochemical and other industries, where evacuation of gaseous or gas-vapor mediums and their subsequent compression are required.

What is claimed is:

1. A liquid-gas ejector comprising an active nozzle and a mixing chamber, wherein the distance between the outlet section of the nozzle and the inlet section of the mixing chamber is determined from the following formula:

$$L = k \cdot \sqrt{\frac{G\alpha}{\mu}}$$

where

L—distance between the outlet section of the nozzle and the inlet section of the mixing chamber (mm);

k—design factor, ranging from 0.001 to 0.3;

α—ratio of the surface area of the minimal cross-section of the active nozzle to the surface area of the minimal cross-section of the mixing chamber;

G—liquid flow rate through the nozzle (g/sec);

$\mu$—coefficient of resistance of the nozzle (g/sec*mm$^2$), amounting from 0.5 to 1.1.

* * * * *